United States Patent [19]

Wada

[11] 4,267,245

[45] May 12, 1981

[54] METHOD OF REMOVING FOREIGN MATERIALS FROM MAGNETIC DEVELOPERS

[75] Inventor: Kenichi Wada, Sakai, Japan

[73] Assignee: Minolta Camera Kabushiki Kaisha, Japan

[21] Appl. No.: 167,521

[22] Filed: Jul. 11, 1980

[30] Foreign Application Priority Data

Jul. 25, 1979 [JP] Japan ..... 54-95260

[51] Int. Cl.[3] ..... G03G 13/09; G03G 21/00

[52] U.S. Cl. ..... 430/97; 430/122; 430/125; 430/137; 118/603; 118/610; 118/612; 118/652; 118/657; 209/214; 209/219; 355/3 DD

[58] Field of Search ..... 430/97, 102, 122, 125, 430/137; 209/214, 219, 223 A, 226, 221, 224, 227, 230; 118/603, 610, 612, 652, 657; 355/3 DD

[56] References Cited

U.S. PATENT DOCUMENTS

| | | | |
|---|---|---|---|
| 3,455,276 | 7/1969 | Anderson | 209/219 X |
| 3,856,666 | 12/1974 | Yashima | 209/219 |
| 4,102,306 | 7/1978 | Ohta | 118/652 X |
| 4,121,931 | 10/1978 | Nelson | 118/657 X |

FOREIGN PATENT DOCUMENTS 52-19536 2/1977 Japan .

*Primary Examiner*—John D. Welsh

*Attorney, Agent, or Firm*—Wenderoth, Lind & Ponack

[57] ABSTRACT

A method of removing foreign materials from developers characterized by intermittently supplying a magnetic developer to the peripheral surface of a nonmagnetic sleeve provided with a rotatable magnet roller in its interior, while recovering, at a position a specified distance away from the location of supply of the developer along the sleeve peripheral surface, the forward end portion of a layer of the developer moving along the sleeve peripheral surface in a direction opposite to the direction of rotation of the magnetic roller to thereby remove foreign materials from the magnetic developer.

12 Claims, 5 Drawing Figures

METHOD OF REMOVING FOREIGN MATERIALS FROM MAGNETIC DEVELOPERS

BACKGROUND OF THE INVENTION

This invention relates to a method of removing foreign materials from developers, and more particularly to a method by which foreign materials responsible for various objections can be removed from magnetic developers for use in magnetic brush developing apparatus widely used in electrophotographic copiers and like machines.

Presently well known as such magnetic developers are single-component developers composed only of an electroconductive magnetic toner, two-component developers comprising a toner of insulating properties and a magnetic carrier admixed therewith, developers in the form of a mixture of two different kinds of magnetic toners, etc. These developers are used for developing the latent electrostatic images on an image bearing surface to toner images while the developer is being circulated through a magnetic brush developing apparatus. As the developer is repeatedly circulated for a prolonged period of time, foreign materials become mingled with the developer.

Typical of such foreign materials are agglomerates of developer particles gradually formed during prolonged use of the developer. (Toner particles in the developer join with one another into agglomerates when subjected to physical forces or heat during the circulation of the developer through the magnetic brush developing apparatus. Usually the agglomerates are approximately 10 times the size of the toner particles.) Typical examples also include fibers of copy paper (generally having a length more than 10 times the diameter of the toner particles) which become mingled with the developer in a gradually increasing amount. The contamination of the developer with copy paper fibers takes place especially markedly in a magnetic brush developing apparatus for transfer-type electrophotographic copiers in which the developer remaining on the surface of the photoconductive member is recovered after the transfer of images to reuse the recovered developer for development.

The presence of the above-mentioned foreign materials in the developer for use in transfer-type electrophotographic copiers and the like causes various problems, such as deterioration of the transportability of the developer itself, irregularities in developed images and blank portions in transferred image areas. With the magnetic brush developing apparatus, therefore, it is very critical to remove the foreign materials from the developer to prevent occurrence of these problems.

SUMMARY OF THE INVENTION

The main object of the present invention is to provide a novel and useful method of continuously removing foreign materials from particulate magnetic developers.

Another object of the invention is to provide a method of removing foreign materials from developers with ease.

Another object of the invention is to provide a method which can be easily practiced with magnetic brush developing apparatus for removing foreign materials from developers.

Still another object of the invention is to provide a method of removing foreign materials from developer by ingeniously utilizing a novel phenomenon discovered by the present inventor.

These and other objects of the invention are fulfilled by the instant method of removing foreign materials from a magnetic developer comprising a first step of substantially intermittently supplying the developer to the peripheral surface of a nonmagnetic sleeve provided with a rotatable magnet roller in its interior, a second step of causing the supplied developer to travel along the peripheral surface of the sleeve by rotating the magnet roller and the third step of recovering, at a position a specified distance away from the location of supply of the developer along the peripheral surface of the nonmagnetic sleeve, the forward end portion of a layer of the supplied developer moving along the sleeve peripheral surface in a direction opposite to the direction of rotation of the magnet roller.

Stated specifically, the nonmagnetic sleeve sleeve is rotated, at a low speed in the same direction as the direction of rotation of the magnet roller.

More specifically the nonmagnetic sleeve is rotated at a circumferential speed lower than the speed of movement of the supplied developer relative to the peripheral surface of the nonmagnetic sleeve.

More specifically the portion of the supplied developer which tends to move from the location of supply of the developer in the same direction as the rotation of the nonmagnetic sleeve is removed from the peripheral surface of the sleeve.

More specifically the developer is intermittently supplied to the peripheral surface of the nonmagnetic sleeve by intermittently stopping the rotation of the magnet roller while holding the sleeve in rotation.

More specifically the portion of the developer to be recovered is separated from the other portion thereof by bringing the forward end of a blade member into or out of contact with the peripheral surface of the nonmagnetic sleeve at the recovering position in timed relation with the passage of the forward end portion of the developer layer.

More specifically while moving from the supply location to the recovering position along the peripheral surface of the nonmagnetic sleeve, the supplied developer is brought into brushing contact with an image bearing surface to develop a latent electrostatic image to a toner image.

These and other objects, advantages and features of the invention will become apparent from the following description thereof taken in conjunction with the accompanying drawings which illustrate specific embodiment of the invention.

BRIEF DESCRIPTION OF THE DRAWINGS

In the following description, like parts are designated by like reference numbers throughout the several drawings.

DETAILED DESCRIPTION OF THE INVENTION

This invention provides a method of removing foreign materials from developers by ingeniously utilizing the following phenomenon discovered by the present inventor.

First, the background which led the inventor to discover the phenomenon will be described briefly together with a description of the phenomenon.

Figure 1:
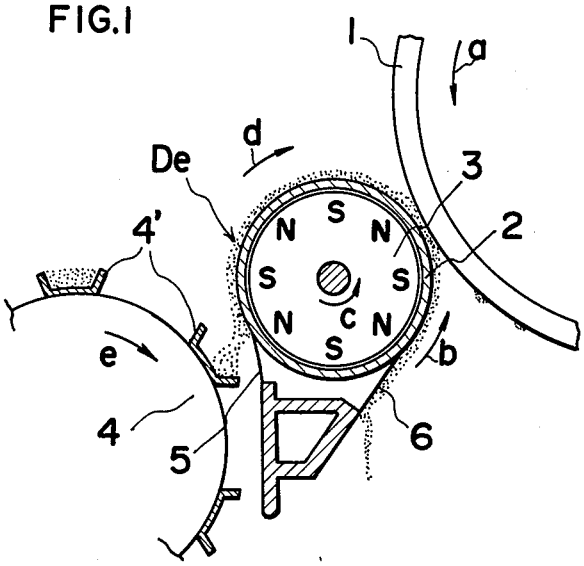
FIG. 1 is a fragmentary diagram showing a magnetic brush developing apparatus developed by the present inventor.

The inventor has developed the apparatus schematically shown in FIG. 1 as a magnetic brush developing apparatus suited for use with a developer comprising a mixture of a nonmagnetic toner having insulating properties and high-resistivity magnetic carrier particles of small size (about 20 μm), or with a developer comprising a nonmagnetic toner of insulating properties and an electroconductive magnetic toner admixed therewith. The apparatus comprises a developing sleeve 2 disposed at a developing station opposed to a photoconductive drum 1 for electrophotography for bearing latent electrostatic images thereon, and a magnet roller 3 provided within the sleeve 2. The developing sleeve 2 is made of a nonmagnetic electroconductive material, such as aluminum or stainless steel, and is rotated in the direction of an arrow b in the figures at a low speed, namely, of 30 r.p.m. The magnet roller 3 is in the form of a roll having S poles and N poles as arranged alternately along its periphery and is rotated at 1300 r.p.m. in the same direction as the sleeve 2, namely, in the direction of an arrow c in the drawing. Accordingly the rotation of the sleeve 2 acts to transport a developer De in the direction of the arrow b, while the rotation of the magnet roller 3 acts to transport the developer De in a direction opposite to the arrow c relative to the sleeve 2. Since the numbers of the revolutions of the two members are set as above, the developer De is consequently moved in the direction of arrow d along the peripheral surface of the sleeve 2. In other words, the circumferential speed of the developing sleeve 2 in the direction of the arrow b is smaller than the speed of movement of the developer De relative to the peripheral surface of the sleeve 2 in the direction opposite to the arrow c (namely, in the direction of the arrow d), so that the developer De is moved in the direction of the arrow d as stated above.

A cleaner 5 extending in opposed relation to the direction b of rotation of the sleeve 2 and a scraper 6 extending in the direction b are disposed below the sleeve 2 in contact therewith. Also disposed below the sleeve 2 on one side thereof is a bucket roller 4 which is rotatable in the direction of an arrow e to supply the developer to the sleeve 2. The bucket roller 4 is provided with a plurality of buckets 4' on its periphery.

Figure 2:
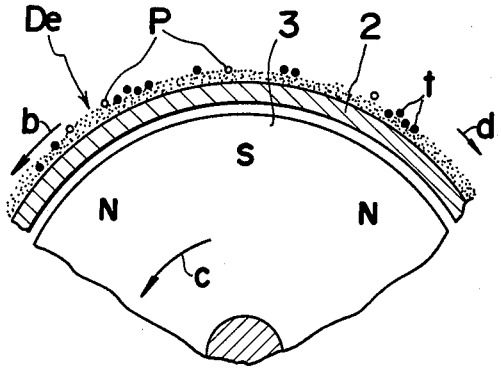
FIG. 2 is an enlarged diagram showing part of the same.

While repeating a developing experiment a large number of times with the magnetic brush developing apparatus described above, the present inventor discovered a peculiar phenomenon involved in the movement of the developer De along the peripheral surface of the developing sleeve 2. This phenomenon was observed progressively noticeably after a prolonged operation, namely, after a latent electrostatic image corresponding to A4 size paper had been developed 30,000 times. The phenomenon is occurrence of variations in the speed of movement of the developer De along the peripheral surface of the developing sleeve 2. The phenomenon will be described in greater detail with reference to FIG. 2 which is a fragmentary enlarged diagram showing the developing sleeve 2 of the apparatus illustrated in FIG. 1.

Initially when the experiment was started, the developer De was moving in the direction of the arrow d uniformly over the peripheral surface of the sleeve 2 at a constant speed (5.0 cm/sec, as actually measured). After a prolonged operation, however, components p and t were observed moving along the periphery of the sleeve 2 toward the direction of the arrow d at a relatively high speed (about 10.0 cm/sec, as actually measured). These components p and t themselves were relatively large, had a tendency to separate out on the surface of the developer De and were therefore moving at a higher speed relative to the developer De. An analysis by the inventor revealed that these components are agglomerates of developer particles, t, and fibers of copy paper, p (hereinafter referred to as foreign materials t and p). As initially found, the developer De other than these foreign materials p and t was observed moving in the direction of the arrow d uniformly along the peripheral surface of the sleeve 2 at a constant speed. Whereas it is thought that the foreign materials p, comprising paper fibers which per se are nonmagnetic, are not magnetically transportable by the magnet roller 3, paper fibers readily cling to magnetic carrier or magnetic toner particles in the developer and consequently behave as if they were magnetic because the fibers have many projections or indentations on their surfaces.

To sum up, the foregoing developing experiment revealed the phenomenon that the agglomerates of developer particles and fibers of copy paper to be removed from the developer as foreign materials move at a high speed along the peripheral surface of the developing sleeve 2 of the magnetic brush developing apparatus shown in FIG. 1.

Figure 3:
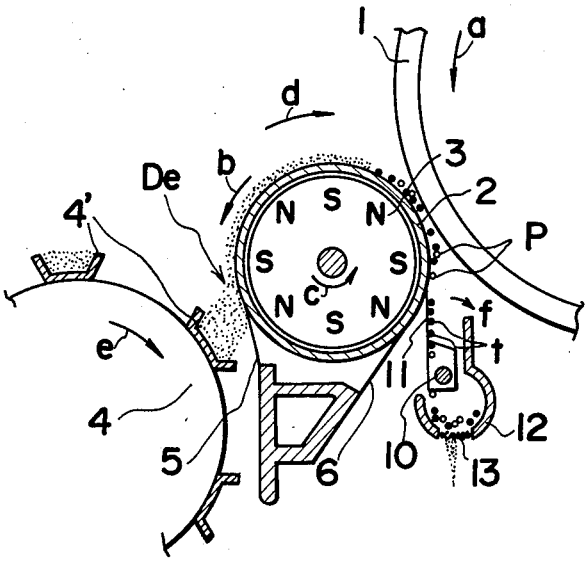
FIGS. 3 and 4 are fragmentary diagrams showing an apparatus for practicing the method of this invention for removing foreign materials from developers, FIG. 3 showing the apparatus in operation during removal of foreign materials, and FIG. 4 showing the same in operation during the development of latent electrostatic images.
Figure 4:
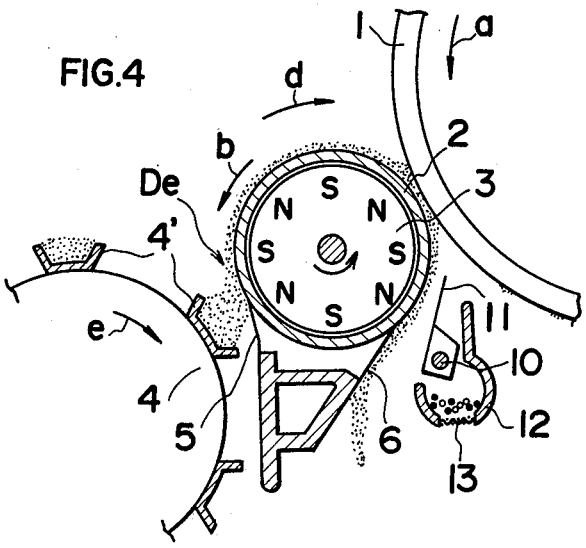
Figure 5:
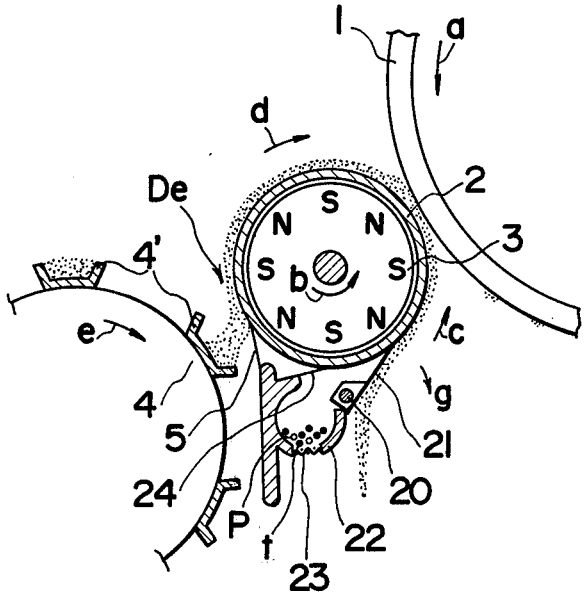
FIG. 5 is a diagram showing a modification of the apparatus.

Described below with reference to FIGS. 3 to 5 are apparatus for practicing the method of this invention for removing foreign materials from a developer and this method as actually practiced with the apparatus. Although the apparatus shown in FIGS. 3 to 5 have a simple construction which comprises many components of the apparatus shown in FIG. 1 and in which the developing sleeve 2 and the magnet roller 3 are used also as components of means for removing foreign materials, the present method can of course be performed with use of an apparatus including a nonmagnetic sleeve and a magnet roller which are separate from the sleeve 2 and the roller 3 and serviceable only for the removal of foreign materials.

With reference to FIGS. 3 and 4, a blade 11 pivotally movable about a pin 10 for collecting foreign materials is disposed near the developing sleeve 2, between the developing station and the location where a scraper 6 is installed. The blade 11 is made from a Mylar plate or phosphor bronze plate about 50 μm in thickness. The blade 11 is movable to an operative position (shown in FIG. 3) in which the blade has its forward end held in contact with the periphery of the sleeve 2, or to a nonoperative position (shown in FIG. 4) where the forward end is held retracted from the periphery of the sleeve 2. Accordingly the developer De moving along the peripheral surface of the sleeve 2 in the direction of an arrow d is scraped off the sleeve surface by the blade 11 when the blade is in its operative position.

Disposed below the blade 11 is a tank 12 for collecting the developer De scraped off the sleeve surface by the blade 11. The collecting tank 12 is provided at a bottom opening thereof with a 50- to 200-mesh screen, through which the developer De collected in the tank 12 and other than foreign materials t and p is selectively allowed to fall. Consequently the foreign materials t and p alone are collected in the tank 12. Although not shown, the collecting tank 12 has in its interior means, such as a spiral roller or coil spring, for discharging the collected foreign materials t and p from the tank 12 to a specified location.

The method of this invention is practiced by the apparatus described above in the following manner. First, with the magnet roller 3 prevented from rotation, the developing sleeve 2 alone is driven in the direction of an arrow b to remove the developer De from the peripheral surface of the sleeve 2 while maintaining the sleeve 2 in the same state as when substantially no developer is supplied to the sleeve 2 by the bucket roller 4 (namely, in a state in which substantially no developer is supplied to the sleeve). Stated more specifically, when only the sleeve 2 is driven in the direction of the arrow b, the developer De on the sleeve 2 is moved in a direction opposite to the arrow d, passing through the location where the developer is supplied to the sleeve 2, and brought to the location of the cleaner 5, where the developer De is scraped off the peripheral surface of the sleeve 2. At the same time, the developer De supplied to the sleeve 2 by the bucket roller 4 is scraped off the sleeve similarly. When desired, a shutter member movable into or out of contact with the sleeve peripheral surface for preventing the movement of the developer in the direction of the arrow d may be provided at a position a small distance away from the developer supplying location in the direction of the arrow d, such that the shutter member, when in contact with the sleeve surface, prevents the movement of the developer to produce the same result as achieved when substantially no developer is supplied to the sleeve surface at the supplying location, notwithstanding the supply of the developer. In this case, the developer on the peripheral surface of the sleeve 2 must be subjected to a force acting to transport the developer toward the direction of the arrow d. Further alternatively, the bucket roller 4 may be prevented from rotation to completely interrupt the supply of the developer De to the sleeve 2. In the latter two cases, the sleeve 2 can be held in the aforementioned state where substantially no developer is supplied thereto, even when the magnet roller 3 is allowed to rotate simultaneously with the rotation of the sleeve.

Next, the magnet roller 3 is initiated into rotation, and the blade 11 is shifted to the operative position shown in FIG. 3. The developer De supplied to the sleeve 2 from the bucket roller 4 now travels in the direction of the arrow d. The phenomenon already described occurs at this time; the foreign materials t and p in the developer De move at a relatively high speed and reach the position of the blade 11 earliest, which position is a specified distance away, along the peripheral surface of the sleeve 2, from the location where the bucket roller 4 supplies the developer De to the sleeve 2, namely, the above-mentioned developer supplying location. When observed collectively, the foreign materials t and p are separated out at the forward end of a travelling layer of developer De, with the result that the foreign materials t and p are scraped off the peripheral surface of the sleeve 2 by the blade 11 and collected in the tank 12.

Subsequently the blade 11 is turned about the pin 10 in the direction of an arrow f to the nonoperative position about the time when the developer De supplied to the sleeve 2 and mainly other than the foreign materials t and p reaches the position of the blade 11 after the magnet roller 3 has been initiated into rotation. This timing can be calculated if the distance between the developer supplying location and the blade 11 is known since the developer except for the foreign materials t and p moves at a speed of 5.0 cm/sec. With the apparatus of FIGS. 3 and 4, the distance is 5.0 cm, so that the timing is 1.0 second or about 1.0 second after the start of rotation of the magnet roller 3.

With the blade 11 shifted to its nonoperative position as above, the developer De other than the foreign materials t and p will not be recovered in the tank 12 but is scraped off the peripheral surface of the sleeve 2 by the scraper 6 and allowed to fall. In this state, the apparatus shown in FIGS. 3 and 4 operates exactly in the same manner as the apparatus shown in FIG. 1 for developing latent electrostatic images.

More specifically stated, a latent electrostatic image is developed to a toner image while the apparatus is in the above state, by bringing the developer into brushing contact with the image bearing surface area of the photoconductive drum 1, at an intermediate portion of path of movement of the developer along the nonmagnetic sleeve peripheral surface to the aforementioned position a specified distance away from the developer supplying location. The same procedure as described above is thereafter repeated by interrupting the rotation of the magnet roller 3 and bringing the blade 11 into and out of contact with the sleeve 2. By repeating this procedure, the foreign materials t and p in the developer De are gradually collected in the tank 12 and removed from the developer De.

With the apparatus shown in FIGS. 3 and 4, foreign materials can be removed from the developer every time a latent electrostatic image is developed, by initiating the magnet roller 3 into rotation, with the developing sleeve 2 held in rotation, 1.0 second before the development of the latent image is started each time, holding the blade 11 in its operative position for 1.0 second immediately after the start of rotation of the roller 3 (while retaining the blade in its nonoperative position at all times except this period) and interrupting the rotation of the magnet roller 3 alone after the latent image has been developed every time. The inventor has confirmed that when the apparatus is thus set for operation, no trouble develops from the presence of foreign materials in the developer even after a latent electrostatic image corresponding to A4 size paper has been developed 50,000 times.

With reference to FIG. 5, a modified apparatus for practicing the method of this invention will be described below.

FIG. 5 shows a scraper 21 which is pivotally movable about a pin 20 in the direction of an arrow g and which performs in its illustrated position the same function as the scraper 6 of the apparatus shown in FIG. 3. When the foreign materials t and p in the developer De are to be collected, the scraper 21 is turned in the direction of the arrow g and will not act to scrape the developer De off the peripheral surface of the developing sleeve 2. The foreign materials t and p passing by the scraper 21 and travelling along the peripheral surface of the sleeve 2 toward the direction of an arrow d are scraped off the sleeve surface by a blade 24 and fall into a collecting tank 22. The tank 22 is provided at a bottom opening thereof with a 50- to 200-mesh screen.

For the removal of foreign materials from developers according to the invention, the apparatus operates in the same manner as the apparatus of FIG. 3 except that the scraper 21 is turned with the same timing as the turn of the blade 11 shown in FIG. 3. However, the scraper 21 must be brought into or out of contact with the sleeve peripheral surface in opposite relation to the blade 11.

Although apparatus for practicing the method of this invention for removing foreign materials from developers have been described in detail with reference to FIGS. 3 to 5, the present method can be performed also be other apparatus. For example, insofar as the developer De on the peripheral surface of the sleeve 2 can be removed therefrom while no developer is supplied to the sleeve 2 and further the developer De is movable in a direction opposite to the direction of rotation of the magnet roller 3 for the removal of foreign materials, the developing sleeve 2 and the magnet roller 3 are rotatable as controlled in various modes. For example, with the sleeve 2 prevented from rotation, the magnet roller 3 may be driven in one direction when no developer is supplied and in the other direction for the removal of foreign materials.

Since it is also known that the developer falling from the developing station under gravity contains substantial amounts of foreign materials, it is useful to position the collecting tank 12 immediately below the developing station for the collection of such developer. The tank can be thus positioned when so desired.

As will be apparent from the foregoing description, foreign materials are removable from developers very effectively by the method of this invention. Additionally the present method can be practiced with an apparatus of simple construction in which many of the components of magnetic brush developing apparatus are utilized.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. A method for continuous removal of foreign materials from a particulate magnetic developer material comprising the steps of:

(a) substantially intermittently supplying said magnetic developer containing said foreign materials to the peripheral surface of a nonmagnetic sleeve containing a rotatable magnet roller concentrically disposed therein;

(b) causing a layer of said supplied developer to travel around the peripheral surface of said sleeve rotating said magnet roller, said developer moving in a direction opposite the direction of rotation of said magnet roller and said foreign materials also moving in the same direction as said developer material but at a substantially higher speed.

(c) recovering, at a position a specified distance away from the location of supply of said developer along said peripheral surface, the forward end portion of said layer of said supplied developer moving around the sleeve peripheral surface.

2. The method of removing foreign materials from a magnetic developer as claimed in claim 1, wherein said nonmagnetic sleeve is rotated at a low speed in the same direction as the direction of rotation of the magnet roller.

3. The method of removing foreign materials from a magnetic developer as claimed in claim 2, wherein said nonmagnetic sleeve is rotated at a circumferential speed lower than the speed of movement of the supplied developer relative to the peripheral surface of the nonmagnetic sleeve.

4. The method of removing foreign materials from a magnetic developer as claimed in claim 3, wherein the portion of said supplied developer which tends to move from the location of supply of the developer in the same direction as the rotation of the nonmagnetic sleeve is removed from the peripheral surface of the sleeve.

5. The method of removing foreign materials from a magnetic developer as claimed in claim 4, wherein said developer is intermittently supplied to the peripheral surface of the nonmagnetic sleeve by intermittently stopping the rotation of the magnet roller while maintaining the sleeve in rotation.

6. The method of removing foreign materials from a magnetic developer as claimed in claim 1, wherein the portion of said supplied developer to be recovered is separated from the remainder thereof by bringing the forward end of a blade member into or out of contact with the peripheral surface of the non-magnetic sleeve at a recovery position in timed relation with the passage of the forward end portion of the developer layer.

7. The method of removing foreign materials from a magnetic developer as claimed in claim 1, wherein said supplied developer is brought into brushing contact with a latent electrostatic image bearing surface to developer said latent electrostatic image to a toner image, while moving from the supply location to the recovering position around the peripheral surface of the nonmagnetic sleeve.

8. The method according to claim 7 wherein said foreign materials comprise agglomerates of said particulate magnetic developer and paper fibers.

9. The method according to claim 8 wherein said particulate magnetic developer is for magnetic brush development and comprises a mixture of a substantially insulating non-magnetic toner and high resistivity magnetic carrier particles.

10. The method according to claim 9 wherein said high-resistivity magnetic carrier particles have a diameter of about 20 $\mu$m.

11. The method according to claim 8 wherein said particulate magnetic developer comprises a mixture of a substantially insulating non-magnetic toner and an electroconductive magnetic toner.

12. The method according to claim 8 wherein said foreign materials travel around the periphery of said sleeve about twice as fast as said developer.

* * * * *